US009423744B2

(12) United States Patent
Kang

(10) Patent No.: US 9,423,744 B2
(45) Date of Patent: Aug. 23, 2016

(54) IMAGE FORMING APPARATUS AND METHOD OF CONTROLLING ENTRY TO POWER SAVE MODE THEREOF

(71) Applicant: Samsung Electronics Co., Ltd., Suwon-si (KR)

(72) Inventor: Soo-young Kang, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/242,222

(22) Filed: Apr. 1, 2014

(65) Prior Publication Data

US 2015/0050039 A1 Feb. 19, 2015

(30) Foreign Application Priority Data

Aug. 16, 2013 (KR) ..... 10-2013-0097347

(51) Int. Cl.
*G03G 15/00* (2006.01)
*G03G 21/00* (2006.01)

(52) U.S. Cl.
CPC ..... *G03G 15/5004* (2013.01); *G03G 15/5016* (2013.01)

(58) Field of Classification Search
CPC ..... G03G 15/5004; G03G 15/5016
See application file for complete search history.

(56) References Cited

U.S. PATENT DOCUMENTS

2004/0061677 A1 4/2004 Hejza Litwiller
2009/0259868 A1* 10/2009 Katoh ..... G03G 15/5004 713/324
2009/0274070 A1* 11/2009 Mukherjee ..... H04W 52/0216 370/257
2012/0133971 A1 5/2012 Park
2012/0140284 A1* 6/2012 Tashiro ..... B41J 3/46 358/1.15
2013/0201516 A1 8/2013 Ito

FOREIGN PATENT DOCUMENTS

EP 2437479 4/2012

OTHER PUBLICATIONS

European Office Action dated Feb. 20, 2015 in European Patent Application No. 14175010.9.
L. McLaughlin III, Editor, "Line Printer Daemon Protocol", <https://tools.ietf.org/html/rfc1179>, Aug. 1990, 14 pages.
Wikipedia, "Line Printer Daemon Protocol", <https://en.wikipedia.org/wiki/Line_Printer_Daemon_protocol>, last modified Jun. 7, 2015, 2 pages.

* cited by examiner

*Primary Examiner* — Clayton E LaBalle
*Assistant Examiner* — Victor Verbitsky
(74) *Attorney, Agent, or Firm* — Staas & Halsey LLP

(57) ABSTRACT

An image forming apparatus controls entry to a power save mode based on an operation state of an external interface device when an operation state of a removable user interface unit satisfies a condition for entering the power save mode.

16 Claims, 11 Drawing Sheets

IMAGE FORMING APPARATUS AND METHOD OF CONTROLLING ENTRY TO POWER SAVE MODE THEREOF

CROSS-REFERENCE TO RELATED APPLICATIONS

This application claims the priority benefit of Korean Patent Application No. 10-2013-0097347, filed on Aug. 16, 2013, in the Korean Intellectual Property Office, the disclosure of which is incorporated herein in its entirety by reference.

BACKGROUND

1. Field

One or more embodiments relate to an image forming apparatus and a method of controlling entry to a power save mode in the image forming apparatus.

2. Description of the Related Art

Recently, methods for reducing standby power of electronic products have been suggested to save energy. For example, standby power of an image forming apparatus such as a printer, a scanner, or a multifunction printer may be saved by allowing the image forming apparatus to enter a power save mode so that partial hardware of the image forming apparatus is turned off when an imaging operation such as printing, copying, or scanning is not performed.

SUMMARY

One or more embodiments include an image forming apparatus and a method of controlling entry to a power save mode in the image forming apparatus.

One or more embodiments include a computer-readable recording medium on which a program for performing the method in a computer is stored.

According to one or more embodiments, an image forming apparatus for controlling entry to a power save mode includes: a control unit configured to determine whether a first operation state of a removable user interface unit satisfies a condition for entering the power save mode; and a network interface unit configured to receive information on a second operation state of an external interface device connected to the image forming apparatus from the external interface device when the first operation state satisfies the condition, wherein the control unit controls entry of the image forming apparatus to the power save mode based on the second operation state.

According to one or more embodiments, an image forming apparatus for controlling entry to a power save mode includes: a control unit configured to determine whether a first operation state of a first interface device satisfies a condition for entering the power save mode; and a network interface unit configured to receive information on a second operation state of a second interface device connected to the image forming apparatus from the second interface device when the first operation state satisfies the condition, wherein the control unit controls entry of the image forming apparatus to the power save mode based on the second operation state.

According to one or more embodiments, a method of controlling entry to a power save mode in an image forming apparatus includes: determining whether a first operation state of a removable user interface unit satisfies a condition for entering the power save mode; receiving information on a second operation state of an external interface device connected to the image forming apparatus from the external interface device when the first operation state satisfies the condition; and controlling entry of the image forming apparatus to the power save mode based on the second operation state.

According to one or more embodiments, a method of controlling entry to a power save mode in an image forming apparatus includes: determining whether a first operation state of a first interface device satisfies a condition for entering the power save mode; receiving information on a second operation state of a second interface device connected to the image forming apparatus from the second interface device when the first operation state satisfies the condition; and controlling entry of the image forming apparatus to the power save mode based on the second operation state.

According to an aspect of one or more embodiments, there is provided at least one non-transitory computer readable medium storing computer readable instructions to implement methods of embodiments.

BRIEF DESCRIPTION OF THE DRAWINGS

These and/or other aspects will become apparent and more readily appreciated from the following description of embodiments, taken in conjunction with the accompanying drawings in which.

DETAILED DESCRIPTION

Figure 1:
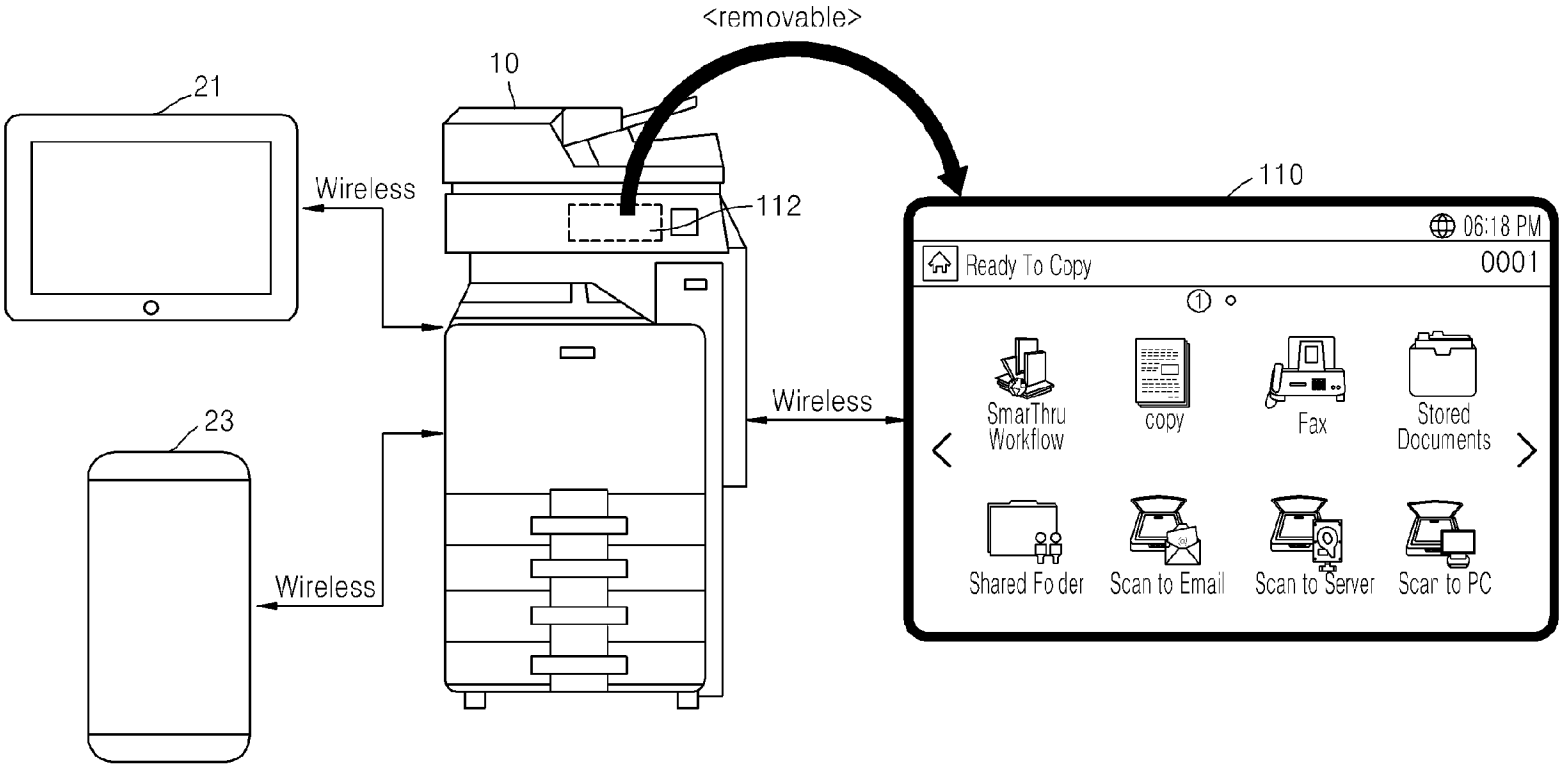
FIG. 1 is a diagram of an image forming system according to an embodiment.

Reference will now be made to embodiments, examples of which are illustrated in the accompanying drawings, wherein like reference numerals refer to like elements throughout. In this regard, embodiments may have different forms and should not be construed as being limited to the descriptions set forth herein. Accordingly, embodiments are merely described below, by referring to the figures, to explain aspects of the present disclosure. Expressions such as "at least one of," when preceding a list of elements, modify the entire list of elements and do not modify the individual elements of the list.

Hereinafter embodiments will be described with reference to the accompanying drawings.

FIG. 1 is a diagram of an image forming system according to an embodiment.

Referring to FIG. 1, the image forming system may include an image forming apparatus 10 and various external interface devices, for example, first and second interface devices 21 and 23, connected to the image forming apparatus 10.

Here, the first interface device 21 may be a tablet, and the second interface device 23 may be a smartphone. However, the tablet or the smartphone is merely an example for describing an embodiment. The first interface device 21 or the second interface device 23 may be other devices connectable to the image forming apparatus 10 wirelessly or by wire, such as a laptop computer, a personal computer, a personal digital assistant, and a wearable device.

Although FIG. 1 only illustrates the image forming apparatus 10, the first interface device 21, and the second interface device 23 for convenience, embodiments are not limited thereto and other devices may be added.

Only hardware components related to an embodiment are shown in FIG. 1 in order not to obscure an embodiment shown in FIG. 1. However, those of ordinary skill in the art understand that general hardware components such as an access point and a network hub may be included in addition to the hardware components illustrated in FIG. 1.

The image forming apparatus 10 may be an individual device such as a printer, a scanner, a copy machine, or a fax machine, or may be a multifunction printer (MFP) in which various functions of individual devices are integrated.

The image forming apparatus 10 includes a user interface unit 110 for displaying information processed in the image forming apparatus 10 to a user or for receiving user input.

In the image forming apparatus 10 according to an embodiment, the user interface unit 110 may be removable by the user.

When the user interface unit 110 is mounted on a coupling unit 112 on the image forming apparatus 10, the user interface unit 110 may communicate with a mainboard in the image forming apparatus 10 through a peripheral component interconnection (PCI) bus and universal serial bus (USB) so as to allow the user to interact with the image forming apparatus 10.

However, when the user interface unit 110 is separate from the coupling unit 112 on the image forming apparatus 10, the user interface unit 110 may communicate with the image forming apparatus 10 wirelessly and still perform the interface function. That is, even if the user interface unit 110 is separate from the image forming apparatus 10, the user interface unit 110 may operate in the same manner as when being mounted on the image forming apparatus 10.

Here, when the user interface unit 110 is separate from the image forming apparatus 10, the user interface unit 110 may communicate with the image forming apparatus 10 by using various wireless communication standards such as Wi-Fi, Wi-Fi direct, Bluetooth, and near field communication (NFC).

That is, the user interface unit 110 of the image forming apparatus 10 according to an embodiment may perform the same user interface function regardless of whether the user interface unit 110 is mounted on or separate from the image forming apparatus 10.

In the case where the first interface device 21 or the second interface device 23 is a mobile device, the image forming apparatus 10 may communicate with the first interface device 21 or the second interface device 23 by using various wireless communication standards such as Wi-Fi, Wi-Fi direct, Bluetooth, and NFC. Alternatively, in the case where the first interface device 21 or the second interface device 23 is a PC, the image forming apparatus 10 may communicate with the first interface device 21 or the second interface device 23 by wire.

Figure 2:
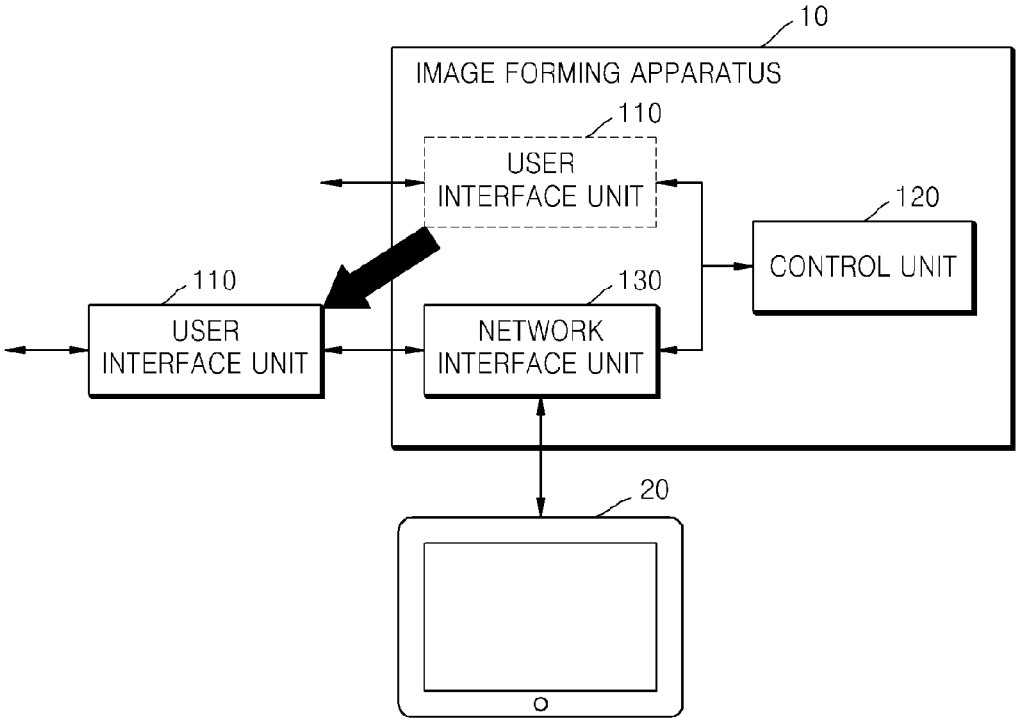
FIG. 2 is a diagram of a configuration of an image forming apparatus according to an embodiment.

FIG. 2 is a diagram of a configuration of the image forming apparatus 10 according to an embodiment.

Referring to FIG. 2, the image forming apparatus 10 may include the user interface unit (user interface device) 110, a control unit (controller) 120, and a network interface unit (network interface) 130. The user interface unit 110 may be a removable user interface device 110.

Only hardware components related to an embodiment will be described with reference to FIG. 2 in order not to obscure an embodiment. However, those of ordinary skill in the art understand that general hardware components may be included in addition to the hardware components illustrated in FIG. 2. For example, the image forming apparatus 10 may further include a printing unit for performing a copying operation or a printing operation, and a scanning unit for performing a scanning operation.

As described above, the user interface unit 110 may removable hardware.

The control unit 120 of the image forming apparatus 10 may be a processor such as a central processing unit (CPU). Such a processor may be implemented with arrays of logic gates or a general microprocessor. Those of ordinary skill in the art understand that the processor may be implemented with various types of hardware or software.

The network interface unit 130 enables the image forming apparatus 10 to be connected to a wired/wireless network, and may include a wired communication module (e.g., an Ethernet interface) or a wireless communication module (e.g., a wireless LAN module supporting Wi-Fi or Wi-Fi direct, an NFC module, and a Bluetooth module).

According to the related art, when an image forming apparatus such as a printer, a scanner, or a multifunction printer does not receive user input through a user interface screen provided to the image forming apparatus for a certain period of time after the user performs an imaging operation through the user interface screen, the image forming apparatus enters a power save mode.

However, when the image forming apparatus directly enters the power save mode based on user input, a user may be still performing an additional imaging operation or may attempt to perform the additional imaging operation through another external device such as a smartphone or a tablet connected to the image forming apparatus and thus may need to switch the power save mode to a normal mode, which is an inconvenience, or an imaging operation that is being processed may be lost.

However, the image forming apparatus 10 according to an embodiment may determine whether external devices (e.g., the first interface device 21 or the second interface device 23) connected thereto are using the image forming apparatus 10 before the image forming apparatus 10 enters the power save mode based on user input. Therefore, the image forming apparatus 10 according to an embodiment may free users of external devices connected to the image forming apparatus 10 from waking up the image forming apparatus 10 from the power save mode and may prevent damage to image operation data of the users.

Figure 3:
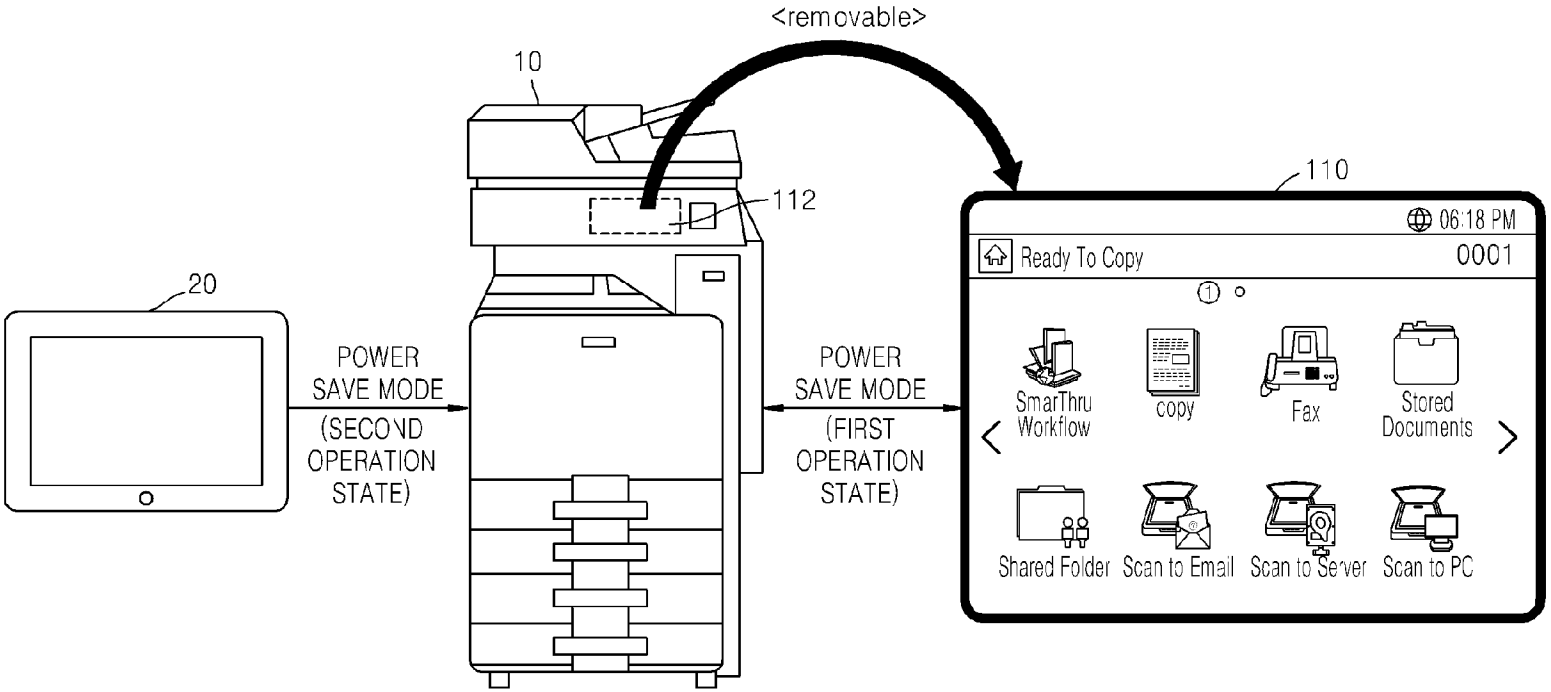
FIG. 3 is a diagram of an operation of the image forming apparatus for controlling entry into a power save mode, according to an embodiment.

FIG. 3 is a diagram of an operation of the image forming apparatus 10 for controlling entry into the power save mode, according to an embodiment.

Referring to FIG. 3, the user interface unit 110 of the image forming apparatus 10 may be separated from the coupling unit 110 of the image forming apparatus 10 to interface with a user.

The image forming apparatus 10 determines whether to enter the power save mode based on a first operation state of a separated user interface unit 110.

When the first operation state corresponds to the power save mode, the image forming apparatus 10 finally determines whether to enter the power save mode based on a second operation state of an external interface device 20.

That is, the image forming apparatus 10 does not enter the power save mode when the second operation state of the external interface device 20 does not correspond to the power save mode even though the first operation state of the separate user interface unit 110 corresponds to the power save mode. The image forming apparatus 10 enters the power save mode when both the first and second operation states of the user interface unit 110 and the external interface device 20 correspond to the power save mode.

Although FIG. 3 illustrates that the user interface unit 110 is separate from the image forming apparatus 10, embodiments not limited thereto. That is, even if the user interface unit 110 is mounted on the image forming apparatus 10, the image forming apparatus 10 may communicate with the external interface device 20 so as to control entry to the power save mode in the same manner as described above.

Although it has been described that the first operation state of the user interface unit 110 is determined first, embodiments are not limited thereto. That is, the image forming apparatus 10 may determine the second operation state of the external interface device 20 first and then may determine the first operation state. In other words, a priority order on the user interface unit 110 and the external interface device 20 may be changed when the image forming apparatus 10 determines whether to enter the power save mode.

Hereinafter the operation of the image forming apparatus 10 described above with reference to FIG. 3 will be described in more detail with reference to FIGS. 4 to 9.

Figure 4:
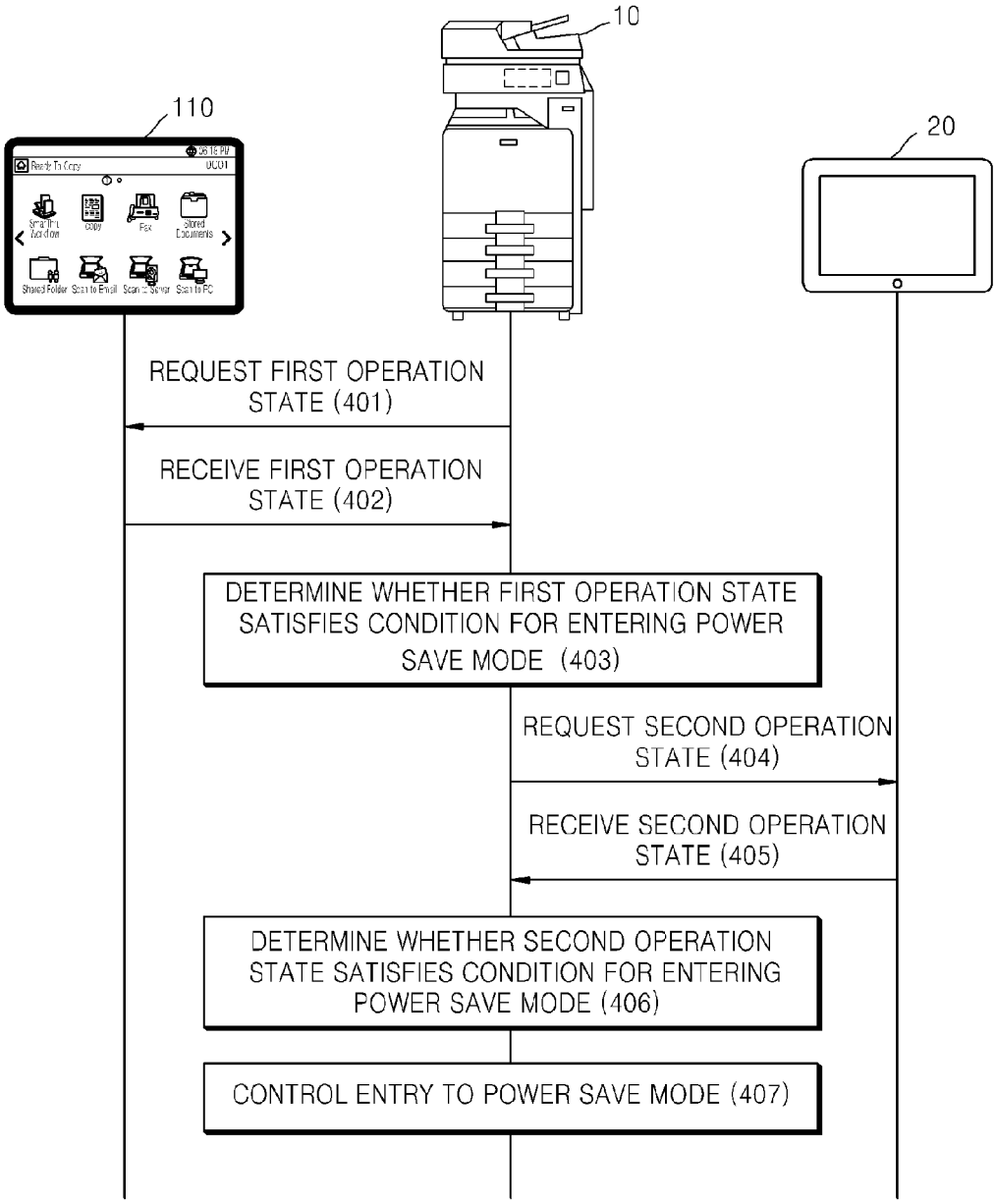
FIG. 4 is a diagram of a process in which the image forming apparatus communicates with a separate user interface unit and an external interface device so as to control entry to a power save mode in the image forming apparatus.

FIG. 4 is a diagram of a process in which the image forming apparatus 10 communicates with the user interface unit 110 separated and the external interface device 20 so as to control entry to the power save mode in the image forming apparatus 10, according to an embodiment.

The process illustrated in FIG. 4 is time-sequentially performed in the image forming apparatus 10 of FIG. 2. Thus, the process illustrated in FIG. 4 will be described in connection with FIG. 2.

In FIG. 4, it is assumed that the user interface unit 110 is separate from the image forming apparatus 10 and is connected thereto wirelessly. However, the process illustrated in FIG. 4 is not limited thereto and may be applied to the case where the user interface unit 110 is mounted on the image forming apparatus 10.

In operation 401, the control unit 120 requests information on the first operation state about a current state of user input to the user interface unit 110, from the user interface unit 110 through the network interface unit 130.

In operation 402, the network interface unit 130 receives the information on the first operation state from the user interface unit 110.

In operation 403, the control unit 120 determines whether the first operation state satisfies a condition for entering the power save mode.

Operations 401 to 403 will be described in more detail. The information on the first operation state that is transmitted from the user interface unit 110 may include information indicating the amount of time the user interface unit 110 receives no user input.

The image forming apparatus 10 may request the information on the first operation state from the user interface unit 110 at intervals of a preset time. Here, the preset time may correspond to timeout.

The image forming apparatus 10 may preset a condition that there be no user input for an arbitrary critical time, as the condition for entering the power save mode.

When the timeout as of the preset time expires, the image forming apparatus 10 requests the information on the first operation state from the user interface unit 110.

The control unit 120 compares the critical time for entering the power save mode with time information on user input absence included in the information on the first operation state so as to determine whether the first operation state satisfies the condition for entering the power save mode.

When there is no user input to the user interface unit 110 for the critical time, the control unit 120 determines that the first operation state corresponds to the power save mode.

However, when there is user input to the user interface unit 110 for the critical time, the control unit 120 determines that the normal mode is maintained. Then, the image forming apparatus 10 resets the timeout as of the preset time.

The preset time corresponding to the timeout and the critical time for entering the power save mode may be changed by a user or a network administrator of the image forming apparatus 10.

The operations below are performed when the first operation state of the user interface unit 110 corresponds to the power save mode.

In operation 404, the control unit 120 requests information on the second operation state of the external interface device 20, from the external interface device 20 through the network interface unit 130.

In operation 405, the network interface unit 130 receives the information on the second operation state from the external interface device 20.

Here, the information on the second operation state includes information indicating that the image forming apparatus 10 is being used or is scheduled to be used by the external interface device 20.

For example, the information indicating that the image forming apparatus 10 is being used, included in the information on the second operation state, may include information indicating that an application for an imaging operation is running in the foreground of the external interface device 20. This information will be described in more detail with reference to FIG. 6.

The information indicating that the image forming apparatus 10 is scheduled to be used, included in the information on the second operation state, may include information indicating that an application for an imaging operation is standing by in the background of the external interface device 20.

Here, the information indicating that the application is standing by may include information on a queue of applications that are running in the background. This information will be described in more detail with reference to FIGS. 7 and 8.

The information on the second operation state may include information input by a user through a popup window that popped up on the external interface device 20.

Here, the popup window that popped up on the external interface device 20 may include a message requesting the user whether to perform an imaging operation. This operation will be described in more detail with reference to FIG. 9.

In operation 406, the control unit 120 determines whether the second operation state satisfies a condition for entering the power save mode.

When the second operation state indicates that the image forming apparatus 10 is being used or is scheduled to be used by the external interface device 20, the control unit 120 determines that the second operation state does not satisfy the condition for entering the power save mode.

In operation 407, the control unit 120 controls entry of the image forming apparatus 10 to the power save mode based on the second operation state.

For example, when the second operation state indicates that the image forming apparatus 10 is being used or is scheduled to be used, the control unit 120 controls the image forming apparatus 10 so that the image forming apparatus 10 operates in the normal mode. However, when the second operation state indicates that the image forming apparatus 10 is not being used or is not scheduled to be used, the control unit 120 controls the image forming apparatus 10 so that the image forming apparatus 10 enters the power save mode.

Figure 5:
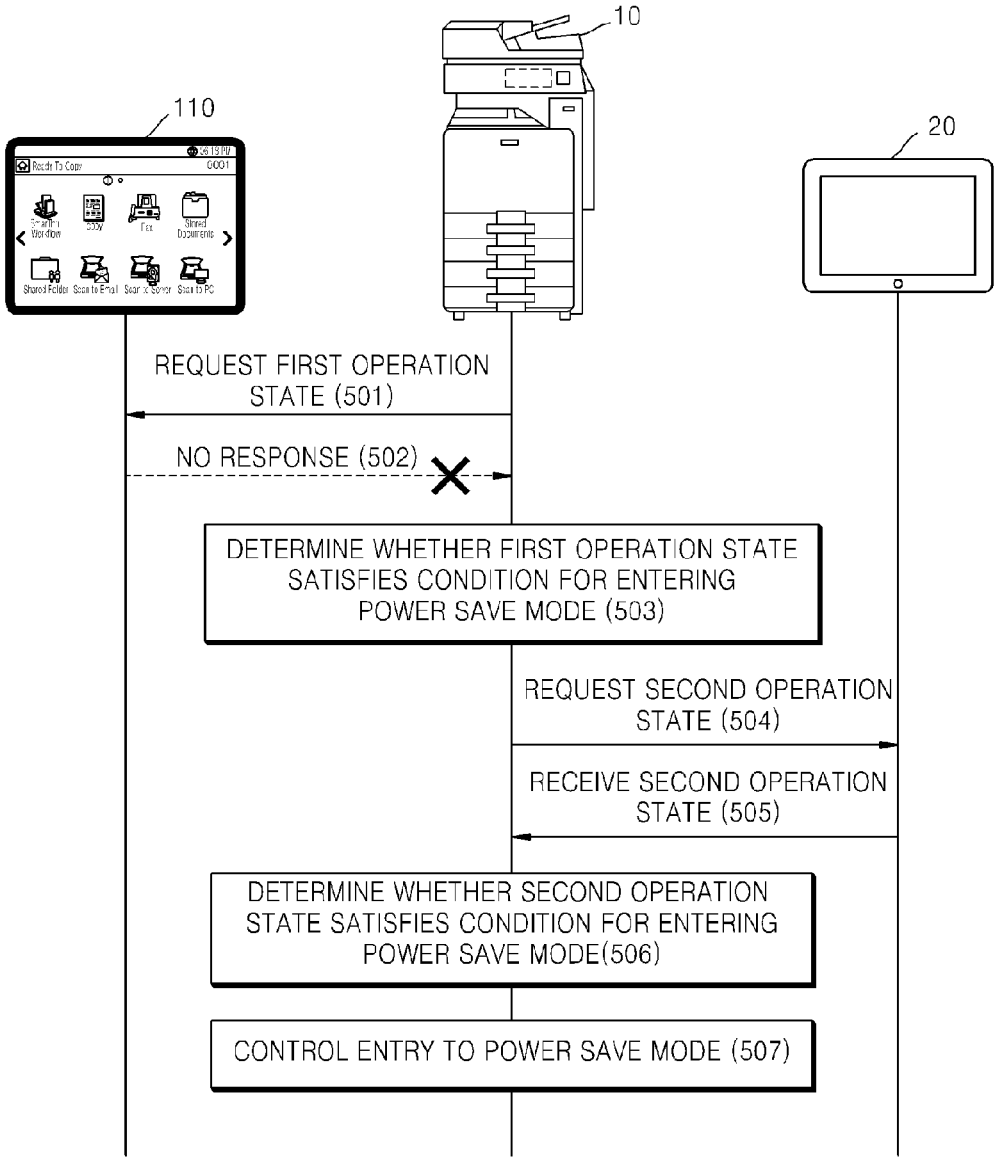
FIG. 5 is a diagram of a process in which the image forming apparatus communicates with a separate user interface unit and an external interface device so as to control entry to a power save mode in the image forming apparatus, according to an embodiment.

FIG. 5 is a diagram of a process in which the image forming apparatus 10 communicates with the separate user interface unit 110 and the external interface device 20 so as to control entry to the power save mode in the image forming apparatus 10, according to an embodiment.

The process illustrated in FIG. 5 is time-sequentially performed in the image forming apparatus 10 of FIG. 2. Thus, the process illustrated in FIG. 5 will be described in connection with FIG. 2.

In FIG. 5, it is assumed that the user interface unit 110 is separate from the image forming apparatus 10 and is connected thereto wirelessly. However, the process illustrated in FIG. 5 is not limited thereto and may be applied to the case where the user interface unit 110 is mounted on the image forming apparatus 10.

In operation 501, the control unit 120 requests information on the first operation state about a current state of user input to the user interface unit 110, from the user interface unit 110 through the network interface unit 130.

The image forming apparatus 10 may request the information on the first operation state from the user interface unit 110 whenever the preset time (timeout) expires.

In operation 502, the network interface unit 130 stands by to receive the information on the first operation state from the user interface unit 110 for the preset time (timeout).

If the first operation state is not received (i.e., there is no response), the network interface unit 130 notifies the control unit 120 that there is no response from the user interface unit 110 for the preset time.

However, if a response indicating that the user interface unit 110 is being used by a user is received from the user interface unit 110 within the preset time (before the timeout expires), the image forming apparatus 10 resets the timeout.

The preset time corresponding to the timeout may be changed by the user or the network administrator of the image forming apparatus 10.

In operation 503, the control unit 120 determines whether the first operation state satisfies a condition for entering the power save mode.

When the network interface unit 130 fails to receive the first operation state (i.e., there is no response), the control unit 120 determines that the first operation state satisfies the condition for entering the power save mode.

However, if a response indicating that the user interface unit 110 is being used by a user is received from the user interface unit 110 within the preset time (before the timeout expires), the control unit 120 determines that the normal mode is maintained.

The operations below are performed when the first operation state of the user interface unit 110 corresponds to the power save mode.

In operation 504, the control unit 120 requests information on the second operation state of the external interface device 20, from the external interface device 20 through the network interface unit 130.

In operation 505, the network interface unit 130 receives the information on the second operation state from the external interface device 20.

Here, the information on the second operation state includes information indicating that the image forming apparatus 10 is being used or is scheduled to be used by the external interface device 20.

In operation 506, the control unit 120 determines whether the second operation state satisfies a condition for entering the power save mode.

When the second operation state indicates that the image forming apparatus 10 is being used or is scheduled to be used by the external interface device 20, the control unit 120 determines that the second operation state does not satisfy the condition for entering the power save mode.

In operation 507, the control unit 120 controls entry of the image forming apparatus 10 to the power save mode based on the second operation state.

For example, when the second operation state indicates that the image forming apparatus 10 is being used or is scheduled to be used, the control unit 120 controls the image forming apparatus 10 so that the image forming apparatus 10 operates in the normal mode. However, when the second operation state indicates that the image forming apparatus 10 is not being used or is not scheduled to be used, the control unit 120 controls the image forming apparatus 10 so that the image forming apparatus 10 enters the power save mode.

Figure 6:
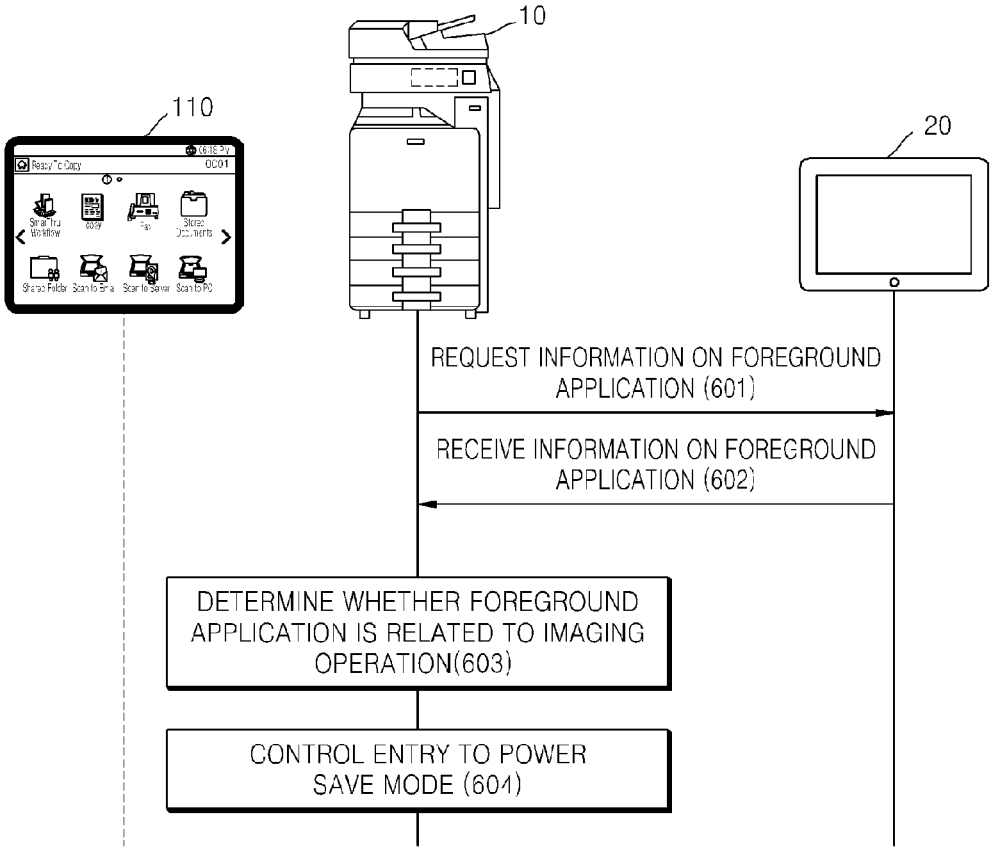
FIG. 6 is a diagram of a process in which the image forming apparatus controls entry to a power save mode by using information on a foreground application running on an external interface device.

FIG. 6 is a diagram of a process in which the image forming apparatus 10 controls entry to the power save mode by using information on a foreground application running on the external interface device 20.

Referring to FIG. 6, operations 601 to 604 may be included in operations 404 to 407 of FIG. 4 or operations 504 to 507 of FIG. 5.

In operation 601, the control unit 120 requests information on the foreground application running on the external interface device 20, from the external interface device 20 through the network interface unit 130. Here, the information on the foreground application may be included in the information on the second operation state described above.

Here, the network interface unit 130 may request the information on the foreground application by transmitting a message such as http://192.168.0.xxx/request/foreground/whatIsForeground to the external interface device 20. Alternatively, the network interface unit 130 may request the information on the foreground application by requesting the external interface device 20 whether an out of box (00B) is running in the foreground application by transmitting a message such as http://192.168.0.xxx/request/foreground/oobIsForeground to the external interface device 20.

In operation 602, the network interface unit 130 receives the information on the foreground application from the external interface device 20.

The external interface device 20 may transmit the information on the foreground application by transmitting a message such as http://192.168.0.xxx/response/foreground/copy to the image forming apparatus 10. Alternatively, the external interface device 20 may transmit the information on the foreground application by transmitting a message such as http://192.168.0.xxx/response/foreground/yes to the image forming apparatus 10.

In operation 603, the control unit 120 determines whether the foreground application relates to an imaging operation.

For example, the foreground application running on the external interface device 20 may be an imaging operation application such as a copy application, a printing application, or a scan application.

If the imaging operation application is running on the external interface device 20, the control unit 120 may determine that a user is using the image forming apparatus 10 through the external interface device 20.

In operation 604, the control unit 120 controls entry of the image forming apparatus 10 to the power save mode based on the information on the foreground application.

Even though the first operation state of the user interface unit 110 corresponds to the power save mode, the control unit 120 controls the image forming apparatus 10 so that the normal mode is maintained when the foreground application is the imaging operation application.

However, if the foreground application is not the imaging operation application, the control unit 120 controls the image forming apparatus 10 so that the image forming apparatus 10 enters the power save mode.

Figure 7:
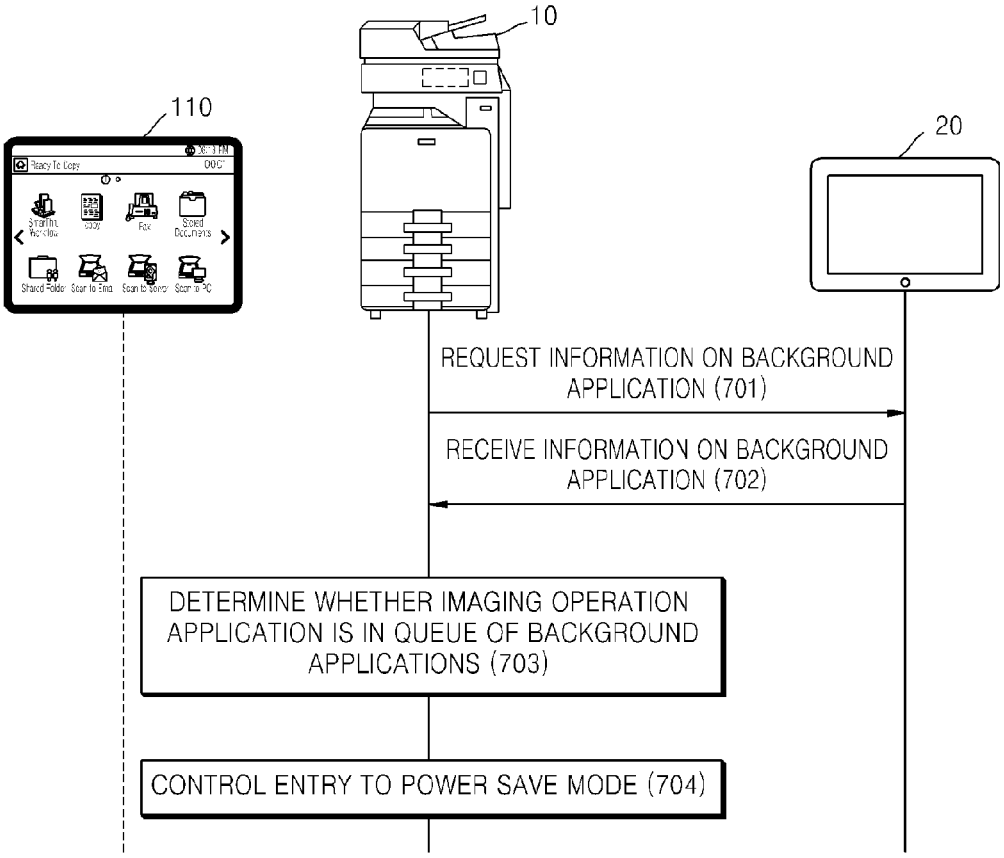
FIG. 7 is a diagram of a process in which the image forming apparatus controls entry to a power save mode by using information on a background application running on an external interface device.

FIG. 7 is a diagram of a process in which the image forming apparatus 10 controls entry to the power save mode by using information on a background application running on the external interface device 20.

Referring to FIG. 7, operations 701 to 704 may be included in operations 404 to 407 of FIG. 4 or operations 504 to 507 of FIG. 5.

It has been described, with reference to FIG. 6, that the image forming apparatus 10 enters the power save mode if the foreground application is not the imaging operation application. However, according to an embodiment, even though the foreground application is not the imaging operation application, the control unit 120 may control the image forming apparatus 10 so that the normal mode is maintained if the imaging operation application is running in the background application. This operation will be described in more detail.

In operation 701, the control unit 120 requests information on the background application running on the external interface device 20, from the external interface device 20 through the network interface unit 130. As described above, the information on the background application may include the information on the queue of applications that are running in the background. The information on the background application may be included in the information on the second operation state described above.

In operation 702, the network interface unit 130 receives the information on the background application from the external interface device 20.

In operation 703, the control unit 120 determines whether an application related to an imaging operation is in the queue of background applications. This operation will be described in more detail with reference to FIG. 8.

Figure 8:
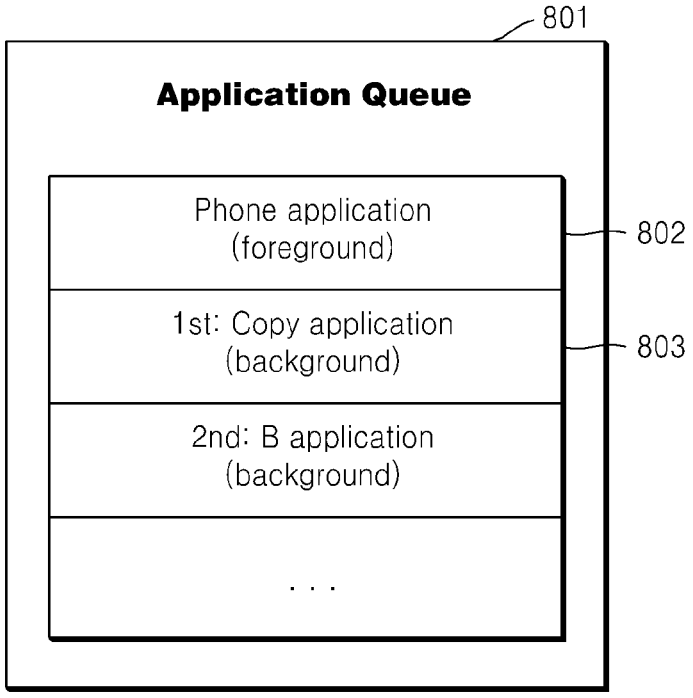
FIG. 8 is a diagram of an application queue included in information on a background application.

FIG. 8 is a diagram of an application queue 801 included in the information on the background application.

Referring to FIG. 8, the application queue 801 running on the external interface device 20 may include a foreground application list and a background application list.

A phone application 802 may be currently running on the external interface device 20 as a foreground application. A copy application 803 may be running on the external interface device 20 as a first background application. Furthermore, application B may be running as a second background application.

While a user performs an imaging operation by using the copy application 803 in the external interface device 20, the user may be called by somebody through the external interface device 20. Here, if the user answers the call, the phone application 802 may be run as a foreground application, and the copy application 803 may be run as a background application. However, it may be assumed that the phone application 802 is finished and the user resumes the imaging operation by using the copy application 803 if the user finishes the call. That is, when the copy application 803 having at least a certain level of priority is in the application queue 801, it may be understood that the user is expected to use the image forming apparatus 10 in a moment.

The certain level of priority may be changed by the user or the network administrator of the image forming apparatus 10.

Referring back to FIG. 7, in operation 703, the control unit 120 determines whether an application related to an imaging operation is in the queue of background applications with at least the certain level of priority.

In operation 704, the control unit 120 controls entry of the image forming apparatus 10 to the power save mode based on the information on the background application.

That is, even though the first operation state of the user interface unit 110 corresponds to the power save mode and the foreground application is not an imaging operation application, the control unit 120 controls the image forming apparatus 10 so that the normal mode is maintained when an imaging operation application having the at least certain level of priority is in the queue of background applications.

However, if there is no background application having the at least certain level of priority is in the queue, the control unit 120 controls the image forming apparatus 10 so that the image forming apparatus 10 enters the power save mode.

The application lists included in the application queue 801 of FIG. 8 are merely examples, and embodiments are not limited thereto.

Figure 9:
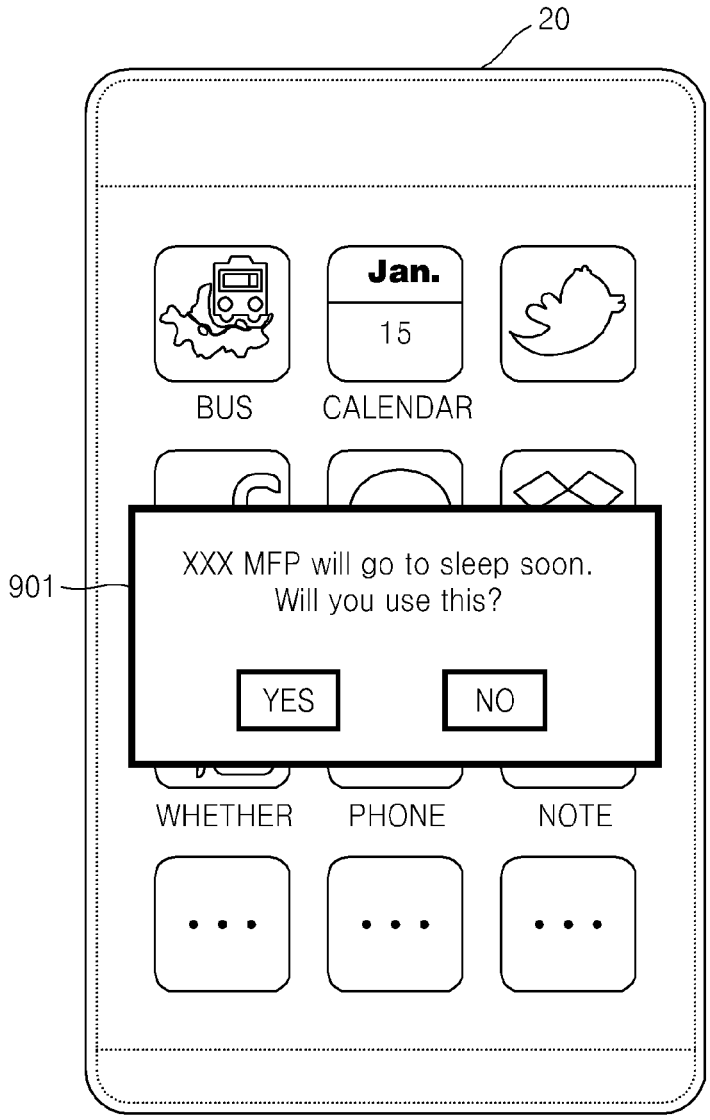
FIG. 9 is a diagram of the case where the image forming apparatus controls entry to a power save mode by using a popup window that popped up on an external interface device.

FIG. 9 is a diagram of the case where the image forming apparatus 10 controls entry to the power save mode by using a popup window 901 that popped up on the external interface device 20.

Referring to FIG. 9, the image forming apparatus 10 may instruct (request) the interface device 20 to pop up a popup window 901 including a message requesting a user whether to perform an imaging operation. This instruction (request) may be transmitted from the image forming apparatus 10 to the external interface device 20 in operation 404 of FIG. 4 or operation 504 of FIG. 5.

When 'YES' or 'NO' is input by the user through the popup window 901, the input information is transmitted to the network interface unit 130. This input information may be transmitted from the external interface device 20 to the image forming apparatus 10 in operation 405 of FIG. 4 or operation 505 of FIG. 5.

If the user inputs 'YES' through the popup window 901, it may be understood that the user is expected to use the image forming apparatus 10. Therefore, the control unit 120 controls the image forming apparatus 10 so that the normal mode is maintained.

Otherwise, if the user inputs 'NO' through the popup window 901, it may be understood that the user is not expected to use the image forming apparatus 10. Therefore, the control unit 120 controls the image forming apparatus 10 so that the image forming apparatus 10 enters the power save mode.

Figure 10:
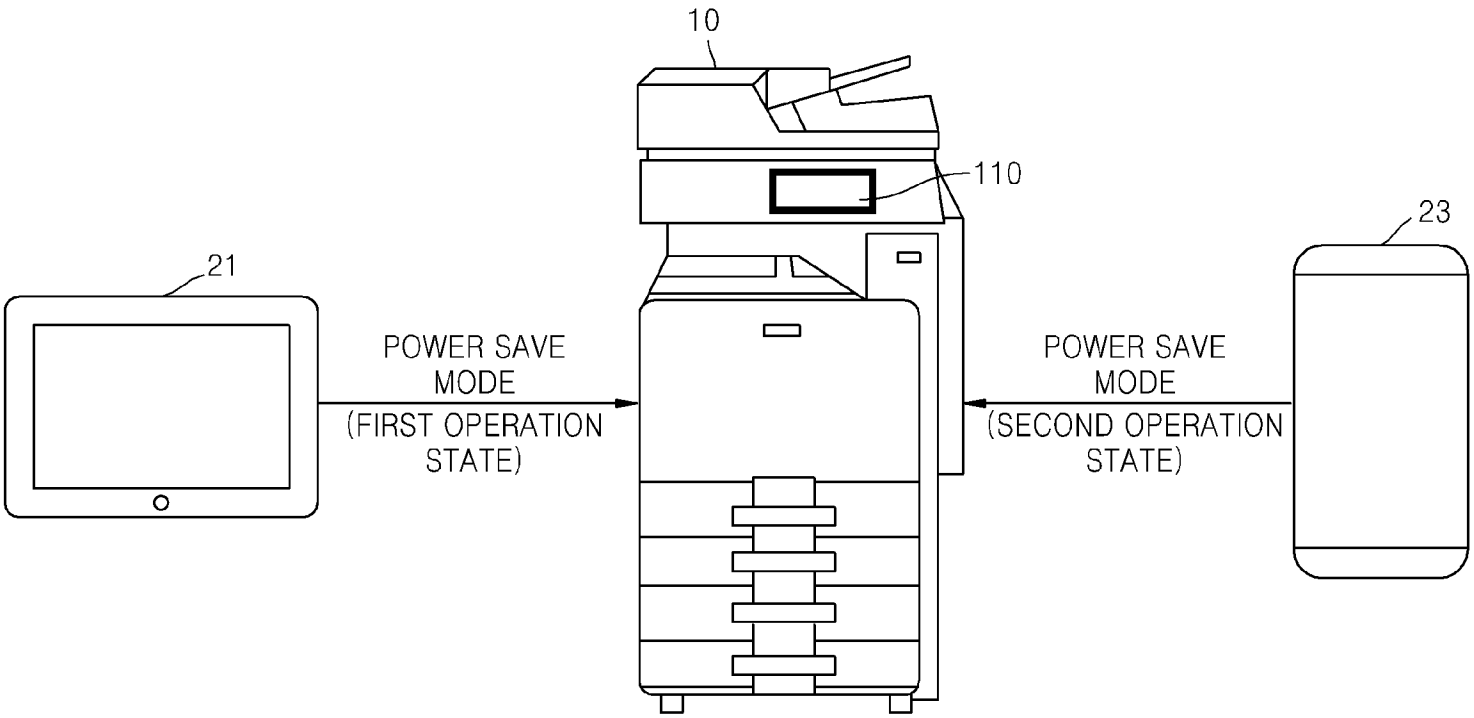
FIG. 10 is a diagram of the image forming apparatus in which entry to a power save mode is controlled through communication with a first interface device and a second interface device.

FIG. 10 is a diagram of the image forming apparatus 10 in which entry to the power save mode is controlled through communication with the first interface device 21 and the second interface device 23.

Referring to FIG. 10, the image forming apparatus 10 controls entry to the power save mode through communication with the first interface device 21 and the second interface device 23 instead of the separate user interface unit 110 and the external interface device 20 (FIG. 2).

That is, comparing FIGS. 2 and 10, the separate user interface unit 110 of FIG. 2 may correspond to the first interface device 21 of FIG. 10, and the external interface device 20 of FIG. 2 may correspond to the second interface device 23 of FIG. 10.

In other words, the image forming apparatus 10 may also control entry to the power save mode by applying the above-described operations to the first interface device 21 and the second interface device 23 instead of the separate user interface unit 110 and the external interface device 20 of FIG. 2.

For example, as described above, the image forming apparatus 10 may determine whether the first operation state of the first interface device 21 corresponds to the power save mode and then may determine the second operation state of the second interface device 23 so as to control entry to the power save mode, and vice versa.

That is, the image forming apparatus 10 according to an embodiment may control entry to the power save mode by using the user interface unit 110 and the external interface device 20, or may control entry to the power save mode only using various interface devices, e.g., the first and second interface devices 21 and 23. That is, embodiments are not limited to one of the cases.

Although FIG. 10 illustrates the user interface unit 110 mounted on the image forming apparatus 10, the user interface unit 110 may be used together with the first and second interface devices 21 and 23 to determine whether to enter the power save mode of the image forming apparatus 10 while being separate from the image forming apparatus 10.

Figure 11:
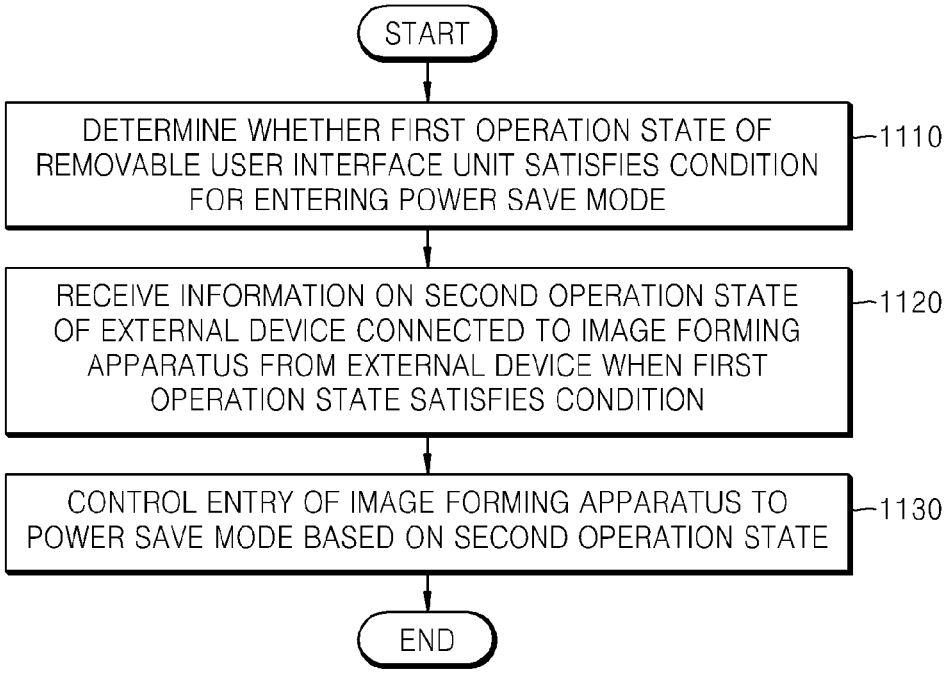
FIG. 11 is a flowchart of a method of controlling entry to a power save mode in the image forming apparatus, according to an embodiment.

FIG. 11 is a flowchart of a method of controlling entry to the power save mode in the image forming apparatus 10, according to an embodiment.

Referring to FIG. 11, the method of controlling entry to the power save mode is time-sequentially performed in the image forming apparatus 10 described above with reference to FIGS. 1 to 9. Therefore, even though the above-descriptions provided with reference to FIGS. 1 to 9 are omitted below, the above-descriptions may also be applied to the method of FIG. 11.

In operation 1110, the control unit 120 determines whether the first operation state of the removable user interface unit (removable user interface device) 110 satisfies a condition for entering the power save mode.

In operation 1120, if the first operation state satisfies the condition for entering the power save mode, the network interface unit 130 receives the information on the second operation state of the external device 20 from the external device 20 connected to the image forming apparatus 10.

In operation 1130, the control unit 120 controls entry of the image forming apparatus 10 to the power save mode based on the second operation state.

Figure 12:
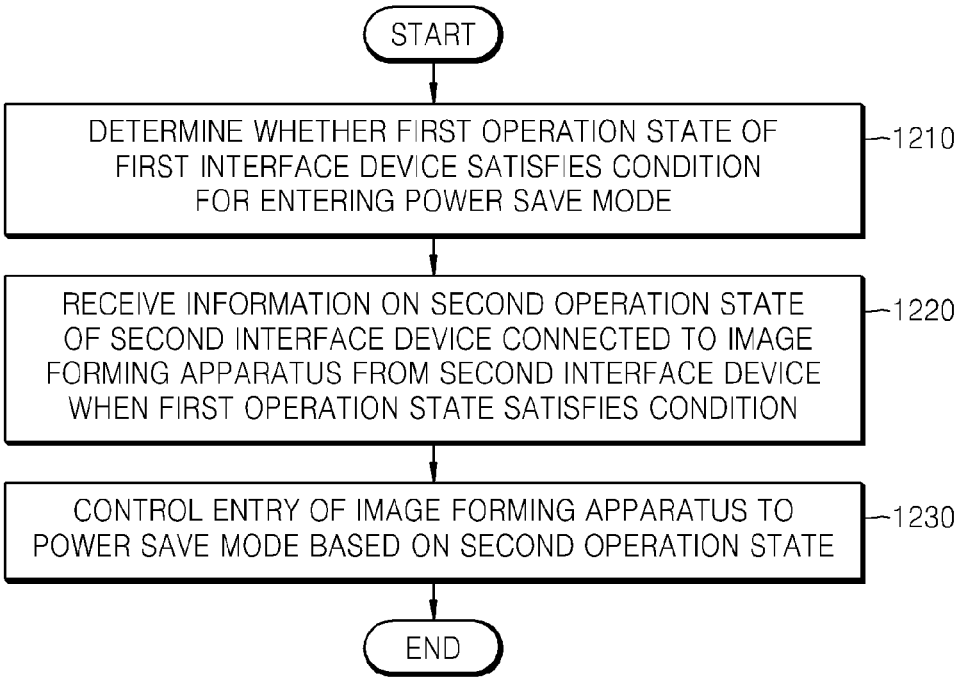
FIG. 12 is a flowchart of a method of controlling entry to a power save mode in the image forming apparatus, according to an embodiment.

FIG. 12 is a flowchart of a method of controlling entry to the power save mode in the image forming apparatus 10, according to an embodiment.

Referring to FIG. 12, the method of controlling entry to the power save mode is time-sequentially performed in the image forming apparatus 10 described above with reference to FIGS. 1 to 10. Therefore, even though the above-descriptions provided with reference to FIGS. 1 to 10 are omitted below, the above-descriptions may also be applied to the method of FIG. 12.

In operation 1210, the control unit 120 determines whether the first operation state of the first interface device 21 satisfies a condition for entering the power save mode.

In operation 1220, if the first operation state satisfies the condition for entering the power save mode, the network interface unit 130 receives the information on the second operation state of the second interface device 23 from the second interface device 23 connected to the image forming apparatus 10.

In operation 1230, the control unit 120 controls entry of the image forming apparatus 10 to the power save mode based on the second operation state.

As described above, according to the one or more embodiments above, an image forming apparatus enters a power save mode after determining whether a device which is performing an imaging operation is present from among a plurality of devices currently connected to the image forming apparatus, and thus the image forming apparatus may be prevented from unintentionally entering the power save mode.

In addition, embodiments can also be implemented through computer-readable code/instructions in/on a non-transitory medium, e.g., a non-transitory computer-readable storage medium, to control at least one processing element to implement any embodiment. The medium can correspond to any medium/media permitting the storage and/or transmission of the computer-readable code/instructions (program instructions).

Processes, functions, methods, and/or software in apparatuses described herein may be recorded, stored, or fixed in one or more non-transitory computer-readable storage media that include program instructions (computer-readable instructions) to be implemented by a computer to cause one or more processing elements (e.g., one or more processors) to execute or perform the program instructions (computer readable instructions). A processing element could include a processor or a computer processor, and processing elements may be distributed and/or included in a single device. The media may also include, alone or in combination with the program instructions, data files, data structures, and the like. The media and program instructions may be those specially designed and constructed, or they may be of the kind well-known and available to those having skill in the computer software arts. Examples of non-transitory computer-readable storage media include magnetic media, such as hard disks, floppy disks, and magnetic tape; optical media such as CD ROM disks and DVDs; magneto-optical media, such as optical disks; and hardware devices that are specially configured to store and perform program instructions, such as read-only memory (ROM), random access memory (RAM), flash memory, and the like. Examples of program instructions include machine code, such as produced by a compiler, and files containing higher level code that may be executed by the computer using an interpreter. The described hardware devices may be configured to act as one or more software modules that are recorded, stored, or fixed in one or more computer-readable storage media, in order to perform the operations and methods described above, or vice versa. In addition, a non-transitory computer-readable storage medium may be distributed among computer systems connected through a network and computer-readable codes or program instructions may be stored and executed in a decentralized manner. In addition, the computer-readable storage media may also be embodied in at least one application specific integrated circuit (ASIC) or Field Programmable Gate Array (FPGA).

It should be understood that the exemplary embodiments described therein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope of the present disclosure as defined by the following claims and their equivalents.

What is claimed is:

1. An image forming apparatus for controlling entry to a power save mode, the image forming apparatus comprising:

a controller to determine whether a first operation state of a removable user interface satisfies a condition for entering the power save mode; and a network interface to receive information on a second operation state of an external interface device connected to the image forming apparatus from the external interface device when the first operation state satisfies the condition, wherein the controller controls entry of the image forming apparatus to the power save mode based on the second operation state when the first operation state satisfies the condition, the controller requests the information on the second operation state to the external interface device through the network interface when a response indicating that there is no user input for a first time is received from the removable user interface or a response is not received from the removable user interface for a second time, and the information on the second operation state comprises information indicating that the image forming apparatus is being used by the external interface device or is scheduled to be used by the external interface device to perform an imaging operation.

2. The image forming apparatus of claim 1, wherein the controller controls the image forming apparatus so that the image forming apparatus operates in a normal mode when the second operation state indicates that the image forming apparatus is being used or is scheduled to be used to perform the imaging operation, or controls the image forming apparatus so that the image forming apparatus enters the power save mode when the second operation state does not indicate that the image forming apparatus is being used or is scheduled to be used to perform the imaging operation.

3. The image forming apparatus of claim 1, wherein the information indicating that the image forming apparatus is being used comprises the information indicating that the application related to the imaging operation is running in the foreground of the external interface device.

4. The image forming apparatus of claim 1, wherein the information indicating that the image forming apparatus is scheduled to be used to perform the imaging operation comprises information indicating that an application related to the imaging operation is standing by in the background of the external interface device.

5. The image forming apparatus of claim 4, wherein the information indicating that the application related to the imaging operation is standing by comprises information on a queue of applications that are running in the background.

6. The image forming apparatus of claim 1, wherein the information on the second operation state comprises information input by a user through a popup window that popped up on the external interface device, the popup window comprising a message requesting the user whether to perform an imaging operation.

7. The image forming apparatus of claim 1, wherein the network interface is connected to the removable user interface wirelessly when the removable user interface is separate from the image forming apparatus.

8. An image forming apparatus for controlling entry to a power save mode, the image forming apparatus comprising:

a controller to determine whether a first operation state of a first interface device satisfies a condition for entering the power save mode; and a network interface to receive information on a second operation state of a second interface device connected to the image forming apparatus from the second interface device when the first operation state satisfies the condition, wherein the controller controls entry of the image forming apparatus to the power save mode based on the second operation state when the first operation state satisfies the condition, the controller requests the information on the second operation state to the second interface device through the network interface when a response indicating that there is no user input for a first time is received from the first interface device or a response is not received from the first interface device for a second time, and the information on the second operation state comprises information indicating that the image forming apparatus is being used by the second interface device or is scheduled to be used by the second interface device to perform an imaging operation.

9. The image forming apparatus of claim 8, wherein one of the first interface device and the second interface device is a removable user interface provided to the image forming apparatus.

10. The image forming apparatus of claim 8, wherein the first interface device and the second interface device are external mobile devices running applications related to the imaging operations and connecting to the image forming apparatus wirelessly.

11. A method of controlling entry to a power save mode in an image forming apparatus, the method comprising:

determining whether a first operation state of a removable user interface satisfies a condition for entering the power save mode;

requesting information on a second operation state to an external interface device connected to the image forming apparatus through a network interface when a response indicating that there is no user input for a first time is received from the removable user interface or a response is not received from the removable user interface for a second time;

receiving the information on the second operation state of the external interface device from the external interface device as a response to the requesting operation; and controlling entry of the image forming apparatus to the power save mode based on the second operation state when the first operation state satisfies the condition, wherein the information on the second operation state comprises information indicating that the image forming apparatus is being used by the external interface device or is scheduled to be used by the external interface device to perform an imaging operation.

12. The method of claim 11, wherein the controlling comprises controlling the image forming apparatus so that the image forming apparatus operates in a normal mode when the second operation state indicates that the image forming apparatus is being used or is scheduled to be used to perform the imaging operation, and controlling the image forming apparatus so that the image forming apparatus enters the power save mode when the second operation state does not indicate that the image forming apparatus is being used or is scheduled to be used to perform the imaging operation.

13. The method of claim 11, wherein the information indicating that the image forming apparatus is being used comprises the information indicating that the application related to the imaging operation is running in the foreground of the external interface device.

14. The method of claim 11, wherein the information indicating that the image forming apparatus is scheduled to be used to perform an imaging operation comprises information indicating that an application related to the imaging operation is standing by in the background of the external interface device.

15. The method of claim 11, wherein the information on the second operation state comprises information input by a user through a popup window that popped up on the external interface device, the popup window comprising a message requesting the user whether to perform an imaging operation.

16. A method of controlling entry to a power save mode in an image forming apparatus, the method comprising:

determining whether a first operation state of a first interface device satisfies a condition for entering the power save mode;

requesting information on a second operation state to a second interface device connected to the image forming apparatus through a network interface when a response indicating that there is no user input for a first time is received from the first interface device or a response is not received from the first interface device for a second time;

receiving the information on the second operation state of the second interface device from the second interface device as a response to the requesting operation; and controlling entry of the image forming apparatus to the power save mode based on the second operation state when the first operation state satisfies the condition, wherein the information on the second operation state comprises information indicating that the image forming apparatus is being used by the second interface device or is scheduled to be used by the second interface device to perform an imaging operation.

* * * * *